United States Patent [19]

Mathison et al.

[11] 4,103,820

[45] Aug. 1, 1978

[54] CARTON WITH INSERT

[75] Inventors: Frederic N. Mathison; Roger E. Straub, both of Camden, Del.

[73] Assignee: General Foods Corporation, White Plains, N.Y.

[21] Appl. No.: 322,235

[22] Filed: Jan. 9, 1973

[51] Int. Cl.[2] ..... B65D 5/10

[52] U.S. Cl. ..... 229/37 R; 40/312; 206/459; 229/70

[58] Field of Search ..... 229/70, 37 R; 206/DIG. 22, 47 R; 40/312, 310

[56] References Cited

U.S. PATENT DOCUMENTS

| | | | |
|---|---|---|---|
| 2,209,657 | 7/1940 | Martin | 40/7 |
| 3,219,253 | 11/1965 | Davis | 229/16 |
| 3,640,447 | 2/1972 | Forbes, Jr. et al. | 229/17 R |
| 3,695,422 | 10/1972 | Tripodi | 206/47 R |

*Primary Examiner*—William Price
*Assistant Examiner*—Bruce H. Bernstein
*Attorney, Agent, or Firm*—Thomas V. Sullivan; Bruno P. Struzzi

[57] ABSTRACT

A carton having an insert of printed matter is disclosed. The insert is affixed or adhered to one or more of the carton flaps on the interior surface thereof and is provided with one or two lines of perforations perpendicular to the length of the insert. The insert so positioned facilitates carton filling, ensures reliability of each carton having an insert and allows for ready access to and easy removal of the insert from the carton.

16 Claims, 5 Drawing Figures

CARTON WITH INSERT

BACKGROUND OF THE INVENTION

This invention relates to cartons adapted for packaging of various types of products and has particular reference to a carton with an insert.

As used herein, "insert" refers to any one of a number of different pieces of printed matter which may be placed within or incorporated into a carton. The insert may be of one or more sheets or it may take the form of folded-over sections of sheet material or the like. The insert may be a coupon such as may be redeemed in a store or mailed to a manufacturer, a recipe sheet, an instruction sheet, a warranty card, a postcard for redemption for a premium or for the purpose of requesting additional information, an envelope with or without a product or sample or a flat pouch. These pieces of printed matter, which may be made from paper, cardboard, plastic films or the like, are capable of being inserted into the carton of this invention and, accordingly, when the term "insert" is used hereinafter, it is intended that all of such pieces are encompassed thereby.

In the promotion of goods and services through advertising, it is frequently desirable to furnish coupons to consumers. These coupons may entitle the consumer to a discount or rebate or bonus or premium on certain of the advertiser's merchandise if presented at the time of purchase or if mailed to the advertiser. In addition, coupons which can be completed and mailed to an advertiser provide a means of obtaining information with respect to a particular product. Besides coupons which are and have been found to be an effective means of advertising, advertisers and manufacturers frequently provide postcards and envelopes for the purpose of having the consumer request additional information from the advertiser or manufacturer. In a similar manner, an advertiser's or manufacturer's recipe sheets, instruction sheets, warranty cards or information sheets pertinent to the product may be supplied to consumers and purchasers.

The distribution and handling of such pieces of printed matter oftentimes causes difficulties. Thus, in the case of coupons, postcards and envelopes, there are frequently placed in newspapers, magazines and the like although extensive use is made of the mails for their distribution. However, considerable expense is involved with such placements and mailings. Another method of putting coupons, postcards and envelopes in the hands of the consumers and purchasers is by means of inserting them into the cartons and packages of products sold by the advertiser or manufacturer. This technique is also employed in the distribution of recipe sheets, instruction sheets, warranty cards and the like. However, this mode of distribution leaves much to be desired in that a considerable amount of handling and cost is involved in order to ensure that each carton or package contains the coupon, postcard, envelope, recipe sheet, instruction sheet, warranty card or the like. This is due to the fact that high speed packaging equipment may be used and the possibility of a carton or package not containing such an insert is increased. On account of this, it is very difficult many times for an advertiser or manufacturer to properly identify a carton or package as containing a specific insert without, at the same time, having to resort to expensive inspection procedures so as to ensure that the carton or package does contain the insert.

SUMMARY OF THE INVENTION

The carton, according to the present invention, however, provides a means whereby inserts may be affixed within carton blanks thus assuring virtually 100% insert reliability on packaging production lines without affecting speed or efficiency and not requiring mechanical modification of the packaging lines and yet permitting quick visibility of, ready access to and easy removal of the insert by the consumer or the purchaser. This is achieved by adhering the insert to the interior surface of the carton blank on at least one of the flaps and providing a line of perforations on the insert perpendicular to the length of the insert so as to facilitate removal of the insert from the carton. Extension of the insert into the flap areas of the carton also facilitates carton filling and serves to bring the insert to the attention of the consumer. Separation of the insert from the carton occurs upon opening of the carton by conventional methods and the consequent breaking of the line of perforations on the insert.

BRIEF DESCRIPTION OF THE DRAWINGS

Reference may be had to the following specification for a more complete description of the invention, the features contributing thereto and the advantages accruing therefrom when read in conjunction with the accompanying drawings wherein.

DESCRIPTION OF PREFERRED EMBODIMENTS

Figure 1:
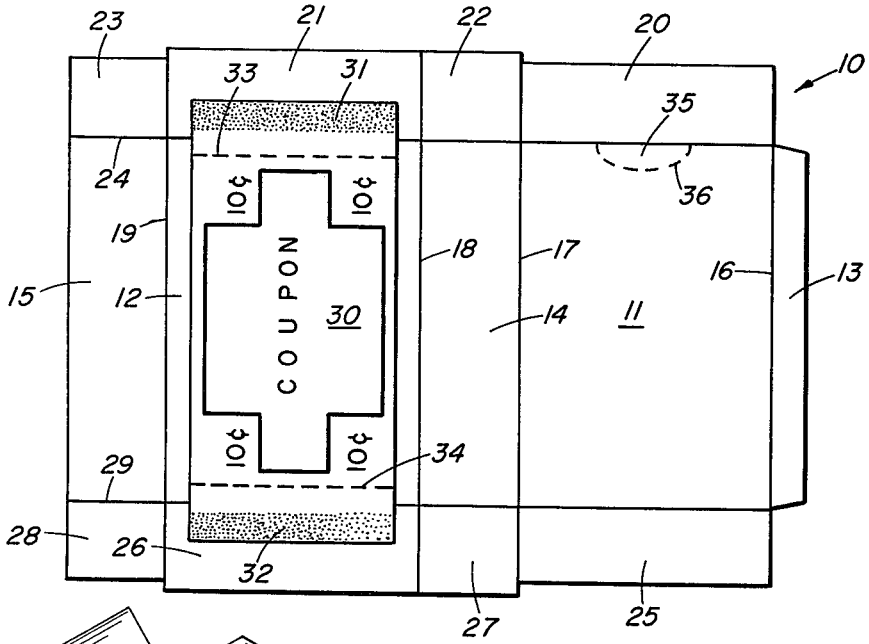
FIG. 1 is an interior plan view of a preferred embodiment of a carton blank as cut and scored for erecting into a carton and having an insert in accordance with the invention.

Referring now to FIG. 1, a carton blank 10 embodying the present invention is formed and cut from a web or sheet of cardboard such as boxboard, paperboard or other semi-rigid packaging material. The blank illustrated in FIG. 1 is designed for erection into a rectangular carton and the surface of the blank which ultimately becomes the interior surface of the resulting carton is shown. The blank, divided by a pattern of scoring and cutting into a plurality of panels or walls and flaps, includes a back panel 11 which may be considered the inside of the back panel of the resulting carton. In this instance, the back panel 11 is substantially co-extensive in area with the front panel 12.

The carton blank as shown includes a small flap extension (manufacturer's glue flap) 13 of back panel 11 which is utilized for the initial formation of the carton and minor or side panels 14 and 15. As shown in FIG. 1, the carton blank is roughly rectangular overall, with back and front panels 11 and 12, small extension flap 13 and minor or side panels 14 and 15 being formed therein by vertically scoring the blank to provide fold lines 16, 17, 18 and 19 between the adjacent panels. The top inner major flap 20, top outer major flap 21 and top minor flaps 22 and 23 extend upwardly from back panel 11, front panel 12 and side panels 14 and 15, respectively, of the blank and are separated by cuts in extension of the vertical fold lines. As shown, horizontal score line 24 is provided across the top extremities of the back, front and side panels of the blank and forms the fold lines along which the top flaps are joined to the panels.

The carton blank as shown further includes bottom inner major flap 25, bottom outer major flap 26 and bottom minor flaps 27 and 28. A horizontal score line 29 extends across the bottom extremities of the back, front and side panels of the blank and forms the fold lines along which the bottom flaps are joined to the panels.

An insert 30, here shown as a printed coupon, is affixed or adhered to the carton blank 10 on top outer major flap 21 at 31 and bottom outer major flap 26 at 32 by glue, adhesive or other suitable means. The insert is provided with two lines of perforations 33 and 34 which are parallel to each other and perpendicular to the length of the insert. The insert is positioned such that the line of perforations 33 is just below horizontal score line 24 and the line of perforations 34 is just above horizontal score line 29.

Easy opening of the carton once erected and closed is achieved by providing a thumb punch-out tab 35 in the top and preferably in the central area of the back panel 11 which punch-out tab is defined by an arcuate line of weakening 36 extending and terminating at the aforementioned score line 24. This line of weakening may comprise a series of spaced slits or perforations of any suitable type of sufficient depth and continuity. The tab is adapted to be severed from back panel 11 by the application of moderate pressure by the thumb of the user.

The insert 30 is applied to the inside of the carton blank 10 by means of conventional windowing equipment prior to formation of the carton. The manner of formation of the carton is then as follows: glue or adhesive is applied to the small flap extension 13 and the carton blank folded on lines 17 and 19 so that the small flap extension 13 is positioned under the side panel 15. This operation is usually completed by the carton manufacturer.

The carton is set up on the production line by forcing the knocked-down carton into the open position (by mechanical fingers or a vacuum pick-off device) by folding along the four fold lines 16, 17, 18 and 19 into a rectangular body.

The minor flaps are then folded inwardly on one end of the carton (flaps 27 and 28, for example), adhesive is applied to the outside of the inner major flap 25, or the inside of the outer major flap 26. The inner major flap 25 is then folded inwardly at right angles to the back panel. The outer major flap 26 is then folded inwardly at a right angle to the front panel to complete the closure. The closure of the bottom flaps is often done after the contents have been placed in the carton.

With the carton structure thus partially formed, the contents are placed in the carton, and with the contents in place, the opposite end minor flaps (flaps 22 and 23 for example) are folded inwardly. Adhesive is applied to the outside of the inner major flap 20 or the inside of the outer major flap 21. The inner major flap 20 is then folded inwardly at right angles to the back panel and the outer major flap 21 folded inwardly over the inner major flap 20 at right angles to the front panel of the carton to complete the closure.

Figure 2:
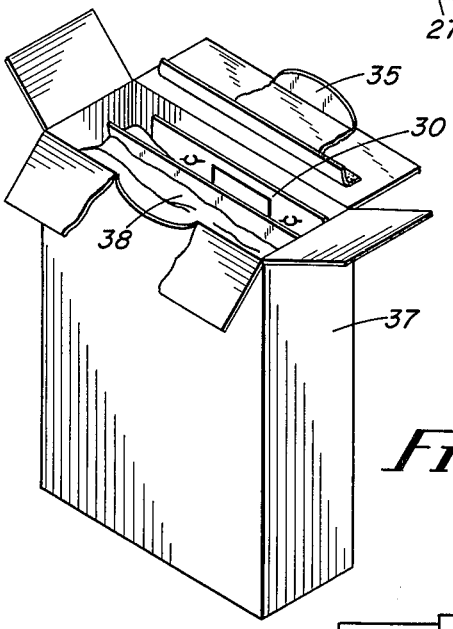
FIG. 2 is a perspective view of the carton blank of FIG. 1 after its having been erected into a filled and closed carton and shows the carton after it has been opened with the closure flaps in an open position and the insert broken away along the line of perforations.

FIG. 2 illustrates the carton blank of FIG. 1 erected and constructed into a carton 37 and later opened. The contents of the carton, here shown in a pourch 38, and the insert 30 are visible and accessible following the use of the thumb tab 35 to tear and lift the top inner major and top outer major flaps 20 and 21 raising them into the position shown. During the lifting of these flaps, the line of perforations (shown as 33 in FIG. 1) is broken exposing a portion of the insert. The insert may then be easily removed from the carton after the pouch is withdrawn by grasping the insert and pulling upwardly so as to break the second line of perforations (shown as 34 in FIG. 1).

Figure 3:
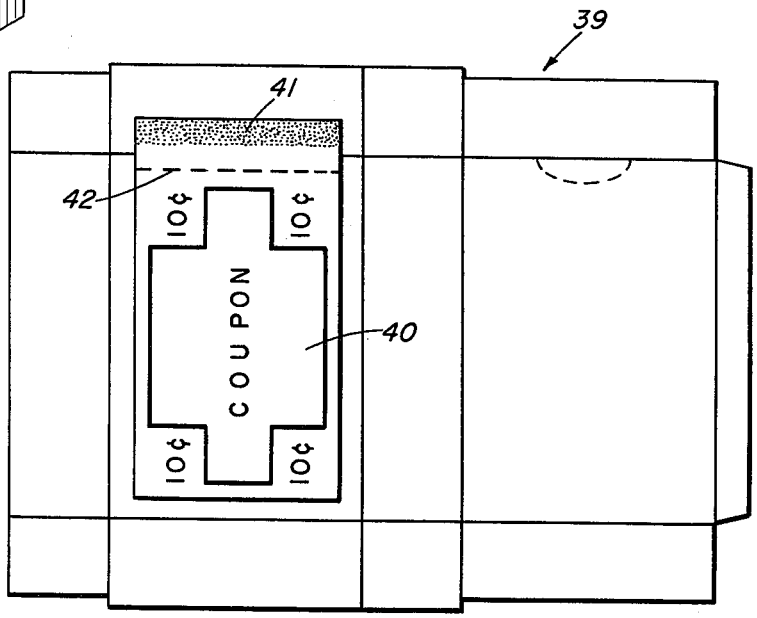
FIG. 3 is an interior plan view of a carton blank as cut and scored for erecting into a carton having an insert in accordance with another embodiment of the invention.

FIG. 3 illustrates a slightly modified embodiment of the invention adaptable for applications where other types of cartons and filling equipment are utilized. According to this embodiment, the panels and flaps of the carton blank 39 are constructed and operate similarly to those in the previously described embodiment except that the insert 40 is adhered to or is affixed to only the top outer major flap at 41 and the insert has but a single line of perforations 42. The bottom portion of the insert is not adhered to or affixed to the bottom major flap nor is the bottom portion of the insert perforated. For some products and with the use of certain cartons, an insert of the type just described and shown is eminently feasible and allows for filling of the cartons from only the top as is the practice with certain packaging machines.

Figure 4:
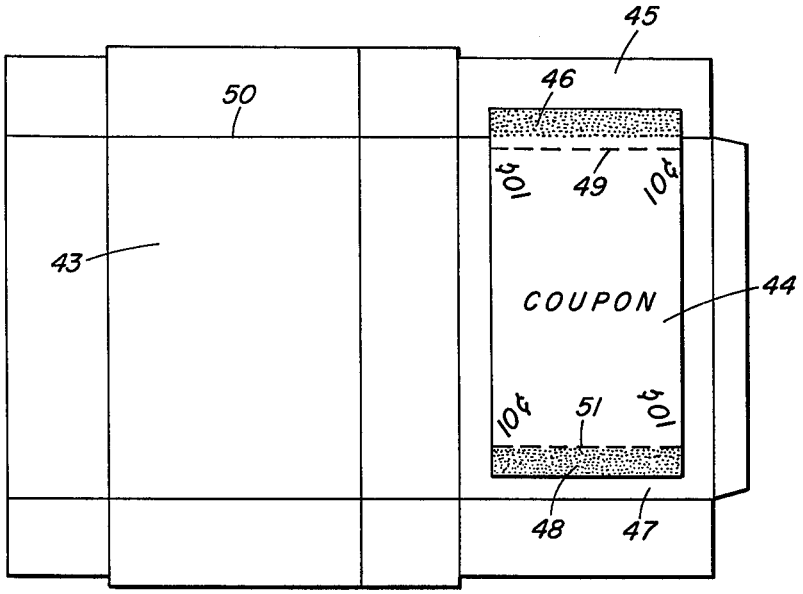
FIG. 4 is an interior plan view of a carton blank as cut and scored for erecting into a carton having an insert in accordance with yet another embodiment of the invention.

FIG. 4 illustrates another modified embodiment of the invention adaptable to applications where the desired length of the insert is less than the height of the panel of the carton and also where it is desired to affix the insert to the back panel of the carton. As shown, the carton blank 43 has the insert 44 adhered to or affixed to the top inner major flap 45 at 46 and to the interior of the back panel 47 at 48. Two lines of perforations are included on the insert, one at 49, below fold line 50, and another at 51 to facilitate removal of the insert from the carton after it has been erected, filled, closed and opened.

Figure 5:
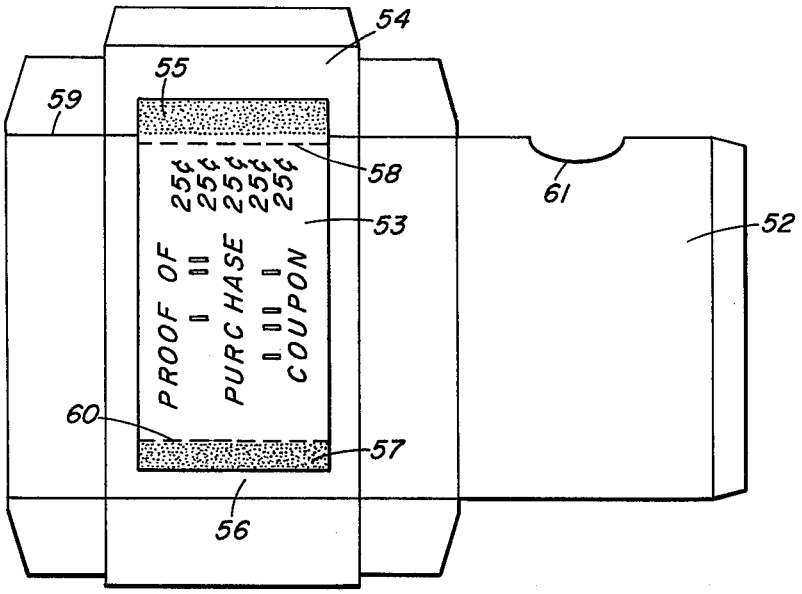
FIG. 5 is an interior plan view of another type of carton blank as cut and scored for erecting into a carton having an insert in accordance with still another embodiment of the invention.

FIG. 5 illustrates an additional modified embodiment of the invention adaptable to applications where other types of filling equipment are utilized or the height of the panel of the carton exceeds the overall length of the insert. According to this embodiment, the panels and flaps of the carton blank 52 have been modified for a tuck style closure. The insert 53 is adhered to or is affixed to the top outer major flap 54 at 55 and to the interior (or inside) of the front panel 56 at 57. Two lines of perforations are included on the insert, one at 58, below fold line 59, and another at 60 to facilitate removal of the insert. A thumb cut-out 61 facilitates easy opening of the carton.

The insert may be affixed inside and to the interior surface of the carton blank by means of conventional windowing equipment. The insert may be adhered to the interior surface of the top major flap or both the top and bottom major flaps on either the front or back panel of the carton. If the carton is constructed in a more square, rather than rectangular form, it is also apparent that the insert may be adhered to the interior surface of one of the minor flaps at either the top of the bottom or both.

Where envelopes or pouches are contemplated as the inserts, it is deemed apparent that the construction thereof should be modified so as to permit their insertion and removal without destroying seals, folds, or the like.

The carton flaps may be adhered to each other and to the panels by glue, adhesive or other equivalent means but it is apparent that the flaps may have slits or cuts provided therein so as to provide for interlocking or may also be modified so as to allow for tuck style closures.

By adhering the insert to the flap, snagging or tearing of the insert is prevented during product insertion and the insert will be obvious to the consumer on opening the carton. At least one line of perforations is included on the insert perpendicular to the length of the insert. The line of perforations when properly positioned along the fold line of the flap is separated by the opening of the carton flap by conventional methods and the insert is removed from the carton by grasping the insert and separating the lower line of perforations, if provided thereon, of the insert, by a slight pull.

The method of inserting cartons as described and shown herein allows for the use of electronic detection devices of various types so as to assure that a carton contains a required insert and also that a carton contains the correct insert. Heretofore, insofar as is known, such reliability has not been possible with other methods of placing inserts in cartons by either mechanical or manual means.

While there have been shown and described what are considered preferred forms of the invention, it will be, of course, understood that obvious changes in form could be made without departing from the spirit of the invention and it is therefore intended that the invention be not limited to precise forms herein shown and described and that the invention is to be construed broadly and restricted by the following appended claims.

What is claimed is:

1. In a carton formed of semi-rigid packaging material which carton includes a pair of opposed face panels joined along fold lines to a pair of opposed side panels:

(a) a flap joined along a fold line to one of said panels;

(b) an insert adhered to the interior surface of said flap and having a line of perforations perpendicular to the length of said insert and extending along said fold line joining said flap and adjacent panel;

(c) said insert further adhered to the interior surface of said adjacent panel and having a second line of perforations perpendicular to the length of said insert.

2. A carton as in claim 1 in which said adjacent panel is a face panel.

3. A carton as in claim 1 in which said adjacent panel is a side panel.

4. In a carton formed of semi-rigid packaging material which carton includes a pair of opposed face panels joined along fold lines to a pair of opposed side panels:

(a) a flap joined along a fold line to one of said panels;

(b) an insert adhered to the interior surface of said flap and having a line of perforations perpendicular to the length of said insert and extending along said fold line joining said flap and adjacent panel;

(c) a second flap joined along a second fold line to said adjacent panel;

(d) said insert further adhered to the interior surface of said second flap and having a second line of perforations perpendicular to the length of said insert and extending along said second fold line joining said second flap and said adjacent panel.

5. A carton as in claim 4 in which said adjacent panel is a face panel.

6. A carton as in claim 4 in which said adjacent panel is a side panel.

7. In a carton formed of semi-rigid packaging material which carton includes a pair of opposed face panels joined along fold lines to a pair of opposed side wall panels:

(a) an inner major flap joined along a first fold line to one of said face panels and of a shape and size substantially co-extensive with the cross-sectional area of said carton so as to substantially enclose one end of said carton;

(b) an outer major flap joined along a second fold line to the other one of said face panels and of substantially the same dimensions as said inner major flaps, said outer flap being adhered to said inner flap;

(c) an insert adhered to the interior surface of one of said flaps and having a line of perforations perpendicular to the length of the insert and extending along the fold line joining said flap and adjacent face panel;

(d) an inner major flap joined along a third fold line to one of said face panels and of a shape and size substantially co-extensive with the cross-sectional area of said carton so as to substantially enclose the other end of said carton; and (e) an outer major flap joined along a fourth fold line to the other one of said face panels and substantially the same dimensions as said inner major flap, said outer flap being adhered to said inner flap and said insert further adhered to the interior surface of one of said flaps and having a second line of perforations perpendicular to the length of said insert and extending along the fold line joining said flap and adjacent face panel.

8. A carton as in claim 7 having a generally tubular configuration of rectangular cross-section and a pair of minor inner flaps joined along fold lines to said side wall panels.

9. In a carton blank formed of semi-rigid packaging material which carton includes a pair of opposed face panels joined along fold lines to side panels:

(a) a flap joined along a fold line to one of said panels;

(b) an insert adhered to the interior surface of said flap and having a line of perforations perpendicular to the length of said insert and extending along said fold line joining said flap and adjacent panel;

(c) said insert further adhered to the interior surface of said adjacent panel and having a second line of perforations perpendicular to the length of said insert.

10. A carton blank as in claim 9 in which said adjacent panel is a face panel.

11. A carton blank as in claim 9 in which said adjacent panel is a side panel.

12. In a carton blank formed of semi-rigid packaging material which carton includes a pair of opposed face panels joined along fold lines to side panels:

(a) a flap joined along a fold line to one of said panels;

(b) an insert adhered to the interior surface of said flap and having a line of perforations perpendicular to the length of said insert and extending along said fold line joining said flap and adjacent panel;

(c) a second flap joined along a second fold line to said adjacent panel;

(d) said insert further adhered to the interior surface of said second flap and having a second line of perforations perpendicular to the length of said insert and extending along said second fold line joining said second flap and said adjacent panel.

13. A carton blank as in claim 12 which said adjacent panel is a face panel.

14. A carton blank as in claim 12 in which said adjacent panel is a side panel.

15. In a carton blank formed of semi-rigid carton packaging material and including a pair of opposed face panels joined along fold lines to side wall panels:

(a) an inner major flap joined along a first fold line to one of said face panels and of a shape and size substantially co-extensive with the cross-sectional area of the carton erected from said blank so as to substantially enclose one end of said carton;

(b) an outer major flap joined along a second fold line to the other one of said face panels and of substantially the same dimensions as said inner major flap, said outer flap being adapted to be adhered to said inner flap;

(c) an insert adhered to the interior surface of one of said flaps and having a line of perforations perpendicular to the length of the insert and extending along the fold line joining said flap and adjacent face panel;

(d) an inner major flap joined along a third fold line to one of said face panels and of a shape and size substantially co-extensive with the cross-sectional area of said carton so as to substantially enclose the other end of said carton; and (e) an outer major flap joined along a fourth fold line to the other one of said face panels and substantially the same dimensions as said inner major flap, said outer flap being adapted to be adhered to said inner flap and said insert further adhered to the interior surface of one of said flaps and having a second line of perforations perpendicular to the length of said insert and extending along the fold line joining said flap and adjacent face panel.

16. A carton blank as in claim 15 adapted to be erected to a generally tubular configuration rectangular in cross-section, said face panels being rectangular.

* * * * *